US007950572B2

(12) United States Patent
Lee et al.

(10) Patent No.: US 7,950,572 B2
(45) Date of Patent: May 31, 2011

(54) REJECT STRUCTURE IN CASH TRANSACTION MACHINE

(75) Inventors: Dong Sik Lee, Seoul (KR); Won Joon Lee, Seoul (KR); Joong Hyuk Han, Seoul (KR)

(73) Assignee: Nautilus Hyosung Inc., Seoul (KR)

( * ) Notice: Subject to any disclaimer, the term of this patent is extended or adjusted under 35 U.S.C. 154(b) by 673 days.

(21) Appl. No.: 11/967,419

(22) Filed: Dec. 31, 2007

(65) Prior Publication Data

US 2009/0039151 A1 Feb. 12, 2009

(30) Foreign Application Priority Data

Aug. 8, 2007 (KR) ..... 10-2007-0079558

(51) Int. Cl.
*G07D 11/00* (2006.01)

(52) U.S. Cl. ..... 235/379; 235/32; 235/100; 235/380; 235/381

(58) Field of Classification Search ..... 235/32, 235/100, 379, 380, 381
See application file for complete search history.

(56) References Cited

U.S. PATENT DOCUMENTS 3,773,252 A * 11/1973 Jensen ..... 232/1 R
6,901,239 B2 * 5/2005 Ahn ..... 399/405

FOREIGN PATENT DOCUMENTS

KR 10-2004-0047448 6/2004

OTHER PUBLICATIONS

Korean Office Action (Korean Patent Application No. 10-2007-0079558) dated Mar. 10, 2009, 5 pages.

* cited by examiner

*Primary Examiner* — Daniel A Hess
*Assistant Examiner* — Michael Andler
(74) *Attorney, Agent, or Firm* — Fenwick & West LLP

(57) ABSTRACT

A reject structure in a cash transaction machine includes a main body of the cash transaction machine including a receiving section wherein a fixed magnet is included in the receiving section; a reject box body being detachably disposed in the receiving section; a reject box shutter being provided on the reject box body to open and close a reject box; and a locking member including a movable magnet in one end of the locking member and being provided pivotably toward a first location capable of locking the reject box shutter and a second location capable of releasing the reject box shutter inside the reject box body, wherein when the reject box body is disposed in the receiving section, the locking member is pivoted toward the location capable of releasing the reject box shutter due to a magnetic force between the fixed magnet and the movable magnet.

5 Claims, 7 Drawing Sheets

REJECT STRUCTURE IN CASH TRANSACTION MACHINE

CROSS-REFERENCE TO RELATED APPLICATION

This application claims priority from Korean Patent Application No. 10-2007-0079558, filed on Aug. 8, 2007, in the Korean Intellectual Property Office, the entire disclosure of which is incorporated herein by reference.

BACKGROUND OF THE INVENTION

1. Field of the Invention

The present invention relates to a reject structure in a cash transaction machine, and more particularly, to a reject structure in a cash transaction machine that can simplify the structure of the cash transaction machine and also can improve the reliability for the cash transaction machine.

2. Description of Related Art

Generally, a cash transaction machine provides basic financial services such as depositing and withdrawal of money and checks using a card or a bankbook, without a bank teller, regardless of time and location.

The cash transaction machine may be classified into a cash dispensing machine and a cash depositing machine depending on depositing/withdrawal of money. Currently, the cash transaction machine is being used for multiple purposes such as depositing and withdrawal of checks, bankbook update, Giro payment, ticket dispensing, and the like, in addition to depositing/withdrawal of cash.

FIG. 1 is a perspective view illustrating a structure of a conventional cash transaction machine.

As shown in FIG. 1, the cash transaction machine is used to deposit and withdraw cash or checks. The housing which forms an external appearance of the cash transaction machine includes a plurality of modules that is provided for each functional unit. The modules include a magnetic card reading module, a bankbook arrangement module, a user interface module, a bill dispensing module, and the like.

In the cash transaction machine, the magnetic card reading module may be externally exposed through a card insertion slot 10. The user interface module may be externally exposed through a display screen 20 or a key input section 25.

Also, the bill dispensing module is externally exposed through a cash dispenser 30. A reject box is disposed adjacent to the cash dispenser 30 inside the cash transaction machine. When cash that is transferred to the cash dispenser 30 is not collected, the cash may be transferred to the reject box and be sequentially collected in the reject box. Therefore, an operator may readily manage the cash using the reject box.

Generally, the reject box is constructed to be selectively opened and closed by a shutter. A locked state of the shutter may be selectively maintained using a locking device, depending on whether the reject box is disposed in the cash transaction machine. Specifically, when the reject box is detached from the cash transaction machine, the locked state of the shutter may be maintained. Conversely, when the reject box is disposed in the cash transaction machine, the locked state of the shutter may be released. Therefore, the operator may dispose the reject box in the cash transaction machine and open the shutter.

However, the locking device of the shutter has a complex structure and is constructed to lock and release the shutter by mechanical contact. Therefore, mechanical noise and abrasion may occur. In the case of extended use, it is difficult to stably lock and release the shutter due to the abrasion.

SUMMARY OF THE INVENTION

An aspect of the present invention provides a reject structure in a cash transaction machine that can maintain and release a locked state of a shutter using a magnetic force of a magnet and thereby can simplify the structure and assembly process of the cash transaction machine.

According to an aspect of the present invention, there is provided a reject structure in a cash transaction machine, including: a main body of the cash transaction machine including a receiving section wherein a fixed magnet is included in the receiving section; a reject box body being detachably disposed in the receiving section; a reject box shutter being provided on the reject box body to open and close a reject box; and a locking member including a movable magnet in one end of the locking member and being provided pivotably toward a first location capable of locking the reject box shutter and a second location capable of releasing the reject box shutter inside the reject box body, wherein when the reject box body is disposed in the receiving section, the locking member is pivoted toward the location of releasing the reject box shutter due to a magnetic force between the fixed magnet and the movable magnet.

In an aspect of the present invention, a scheme of attaching and detaching the reject box body with respect to the main body may be variously modified depending on a required condition and a design specification. For example, the reject box body may be detachably disposed in the receiving section using a general sliding scheme.

Also, a scheme of opening and closing the reject box shutter may be variously modified depending on the required condition and the design specification. For example, the reject box shutter may be provided on the reject box body to open and close the reject box using a general sliding scheme. Depending on embodiments, the reject box shutter may be constructed to rotate on one point and thereby open and close a retrieval hole using a general rotating scheme.

Also, the fixed magnet and the movable magnet may be constructed to have the same polarity so that a repulsive force may be formed between the fixed magnet and the movable magnet. The repulsive force between the fixed magnet and the movable magnet may enable the locking member to pivot. Depending on embodiments, the fixed magnet and the movable magnet may be constructed to form an attractive force between the fixed magnet and the movable magnet.

In an aspect of the present invention, the reject structure may further include a guide bracket being disposed adjacent to the locking member inside the reject box body. When the fixed magnet enters the reject box body, the guide bracket may be disposed between the fixed magnet and the movable magnet. Also, a hole may be formed in the guide bracket and the magnetic force between the fixed magnet and the movable magnet may be formed through the hole.

The guide bracket may be formed of a metal material. In this case, an organized state of the locking member may be maintained due to the attractive force between the guide bracket and the movable magnet. Depending on embodiments, the organized state of the locking member may be elastically maintained using a general elastic member such as a spring.

The reject box shutter may be opened by manual manipulation of the operator. Also, when the reject box body is disposed in the receiving section, the reject box shutter may be opened. The structure to interoperate the reject box shutter when installing the reject box body may be variously modified based on the required condition and the design specification. For example, the reject box shutter may include a shutter protrusion that is externally exposed from the reject box body. The main body may include a binding protrusion to contact with the shutter protrusion and bind the shutter protrusion.

BRIEF DESCRIPTION OF THE DRAWINGS

The above and other aspects of the present invention will become apparent and more readily appreciated from the following detailed description of certain exemplary embodiments of the invention, taken in conjunction with the accompanying drawings of which.

DETAILED DESCRIPTION OF EXEMPLARY EMBODIMENTS

Figure 1:
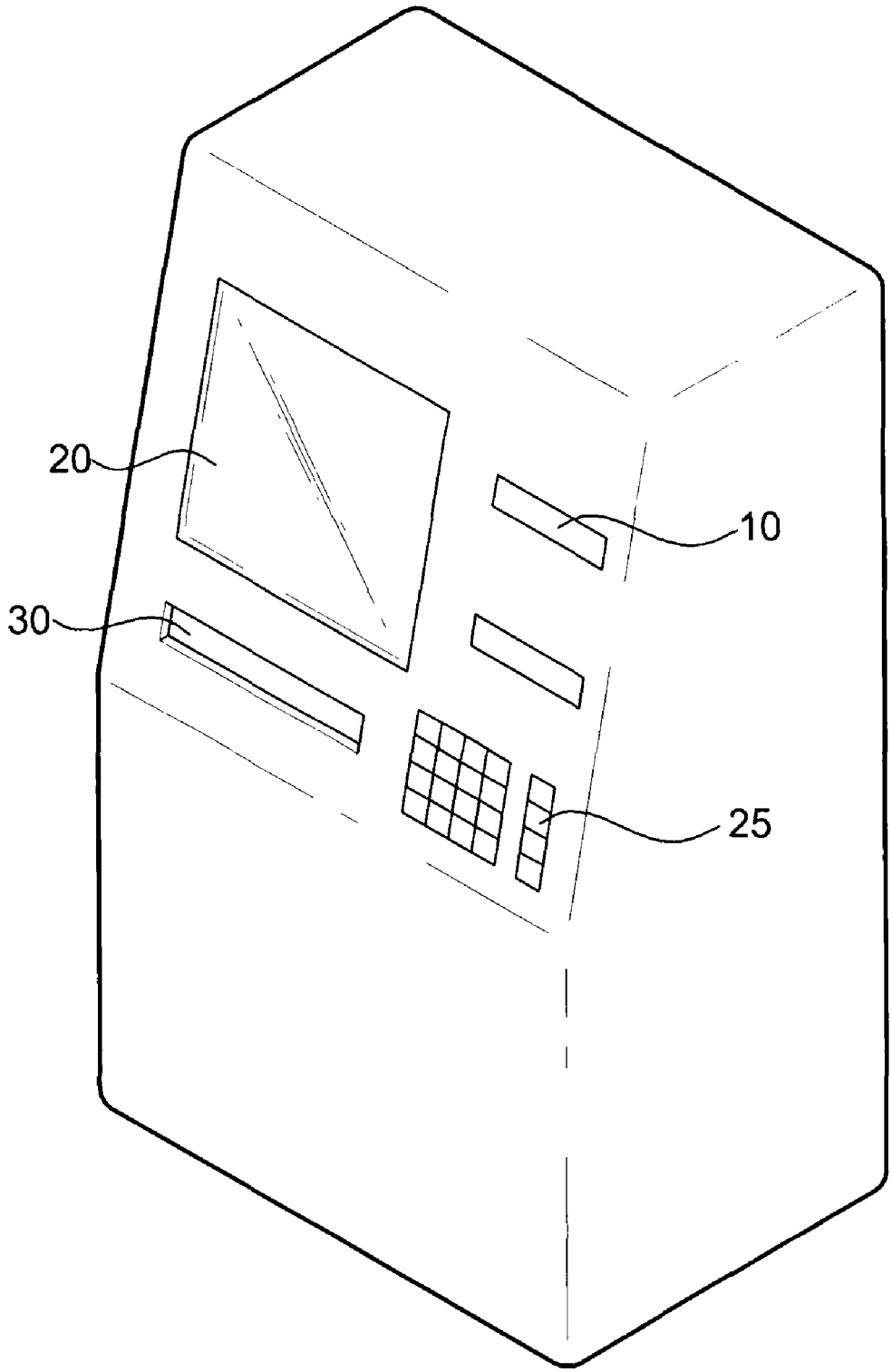
FIG. 1 (CONVENTIONAL ART)
FIG. 1 is a perspective view illustrating the structure of a conventional cash transaction machine.

Reference will now be made in detail to exemplary embodiments of the present invention, examples of which are illustrated in the accompanying drawings, wherein like reference numerals refer to the like elements throughout. The exemplary embodiments are described below in order to explain the present invention by referring to the figures.

Figure 2:
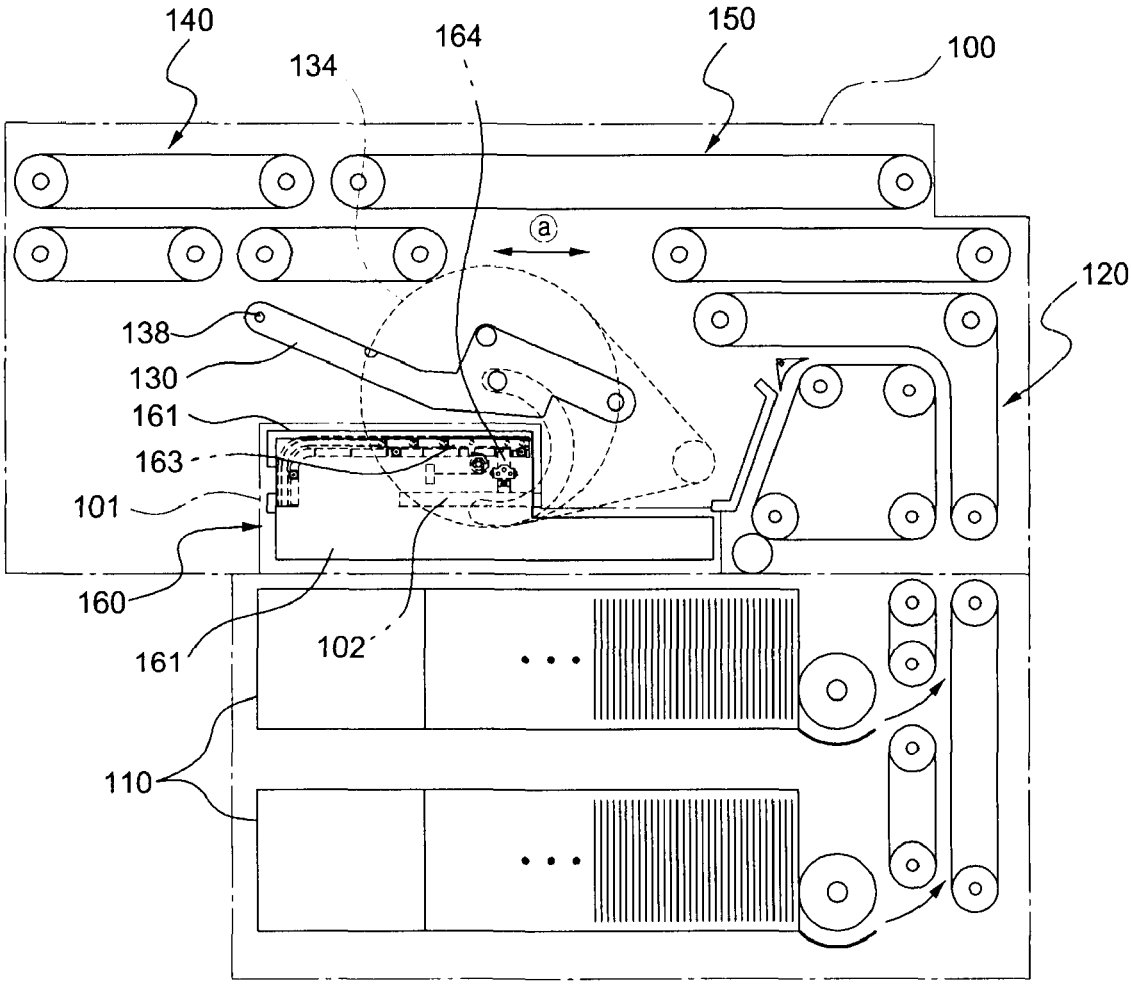
FIG. 2 is a cross-sectional view for describing a cash transaction machine including a reject box according to an exemplary embodiment of the present invention.
Figure 3:
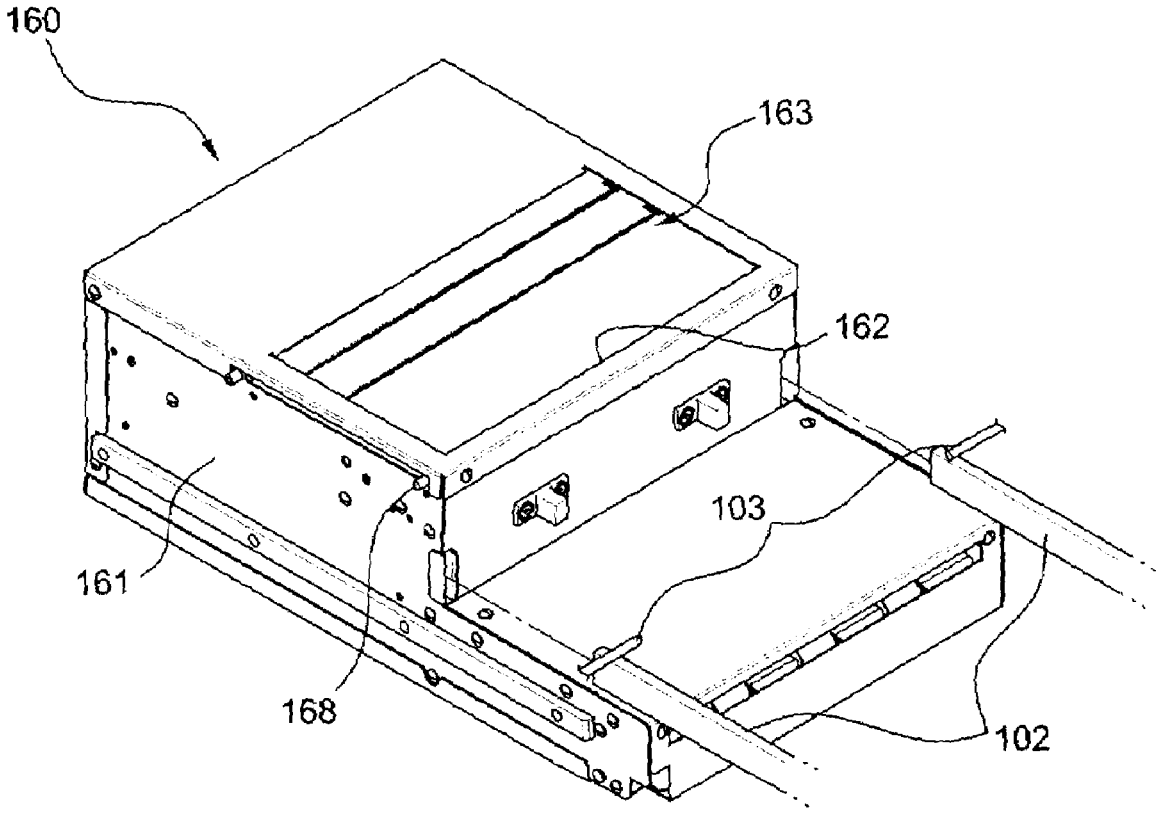
FIG. 3 is a perspective view illustrating a structure of a reject box for a cash transaction machine according to an exemplary embodiment of the present invention.
Figure 4:
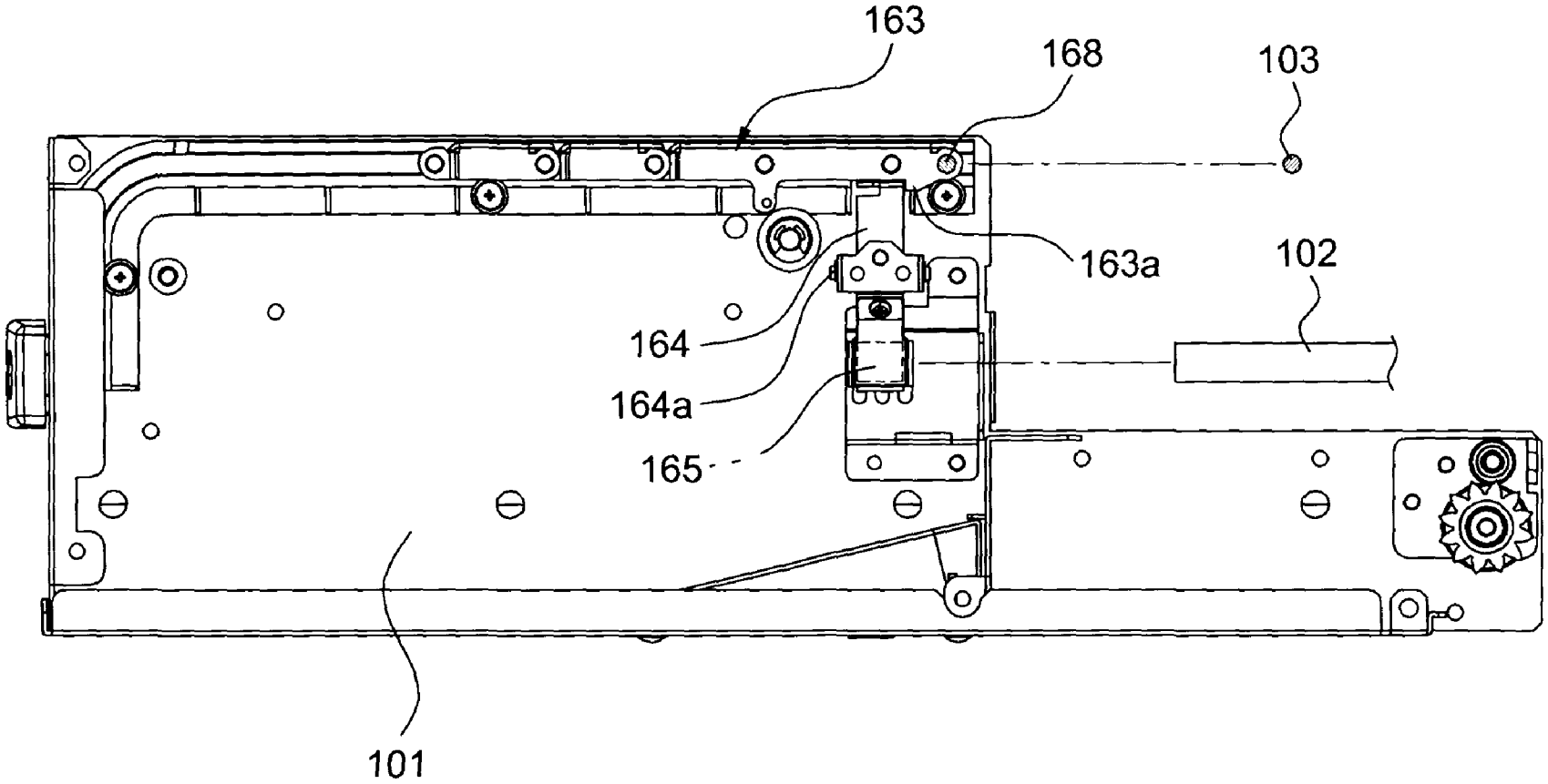
FIG. 4 is a cross-sectional view illustrating an internal structure of a reject box for a cash transaction machine according to an exemplary embodiment of the present invention.
Figure 5:
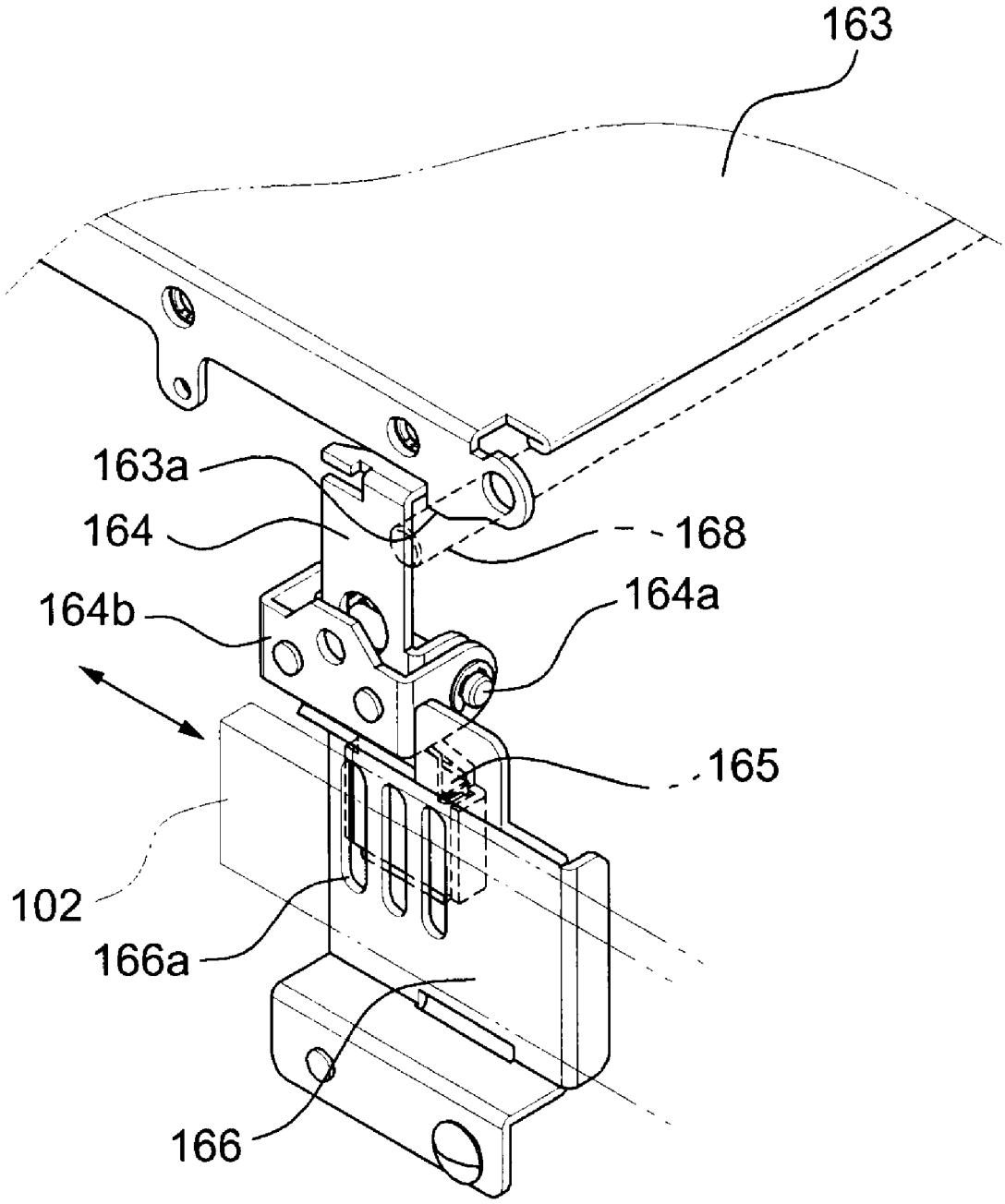
FIG. 5 is a perspective view illustrating an internal structure of a reject box for a cash transaction machine according to an exemplary embodiment of the present invention.

FIG. 2 is a cross-sectional view for describing a cash transaction machine including a reject box according to an exemplary embodiment of the present invention. FIG. 3 is a perspective view illustrating a structure of a reject box for a cash transaction machine according to an exemplary embodiment of the present invention. FIG. 4 is a cross-sectional view illustrating an internal structure of a reject box for a cash transaction machine according to an exemplary embodiment of the present invention. FIG. 5 is a perspective view illustrating an internal structure of a reject box for a cash transaction machine according to an exemplary embodiment of the present invention.

As shown in the figures, the cash transaction machine including the reject box according to the present invention may include a main body 100, a storage section 110, a temporary stack section 130, a first transfer section 120, a money dispensing section 140, a second transfer section 150, and a reject box 160.

The storage section 110 is disposed in the main body 100. Paper media are stored in the storage section 110. The stored paper media may be externally discharged from the storage section 110 one sheet at a time, corresponding to rolling of a pick-up roller. Also, the discharged paper media may be transferred to the temporary stack section 130 by the first transfer section 120.

The first transfer section 120 transfers the paper media from the storage section 110 to the temporary stack section 130. The first transfer section 120 connects a plurality of transfer rollers using a transfer belt. The paper media are transferred from a lower portion to an upper portion of a dispensing device along a transfer route. The transfer route is provided by rotation of the transfer rollers. The first transfer section 120 discharges the paper media to the upper portion of the temporary stack section 130 that is formed in an outlet of the first transfer section 120.

As described above, the temporary stack section 130 is formed in the outlet of the first transfer section 120. Due to a cam rotation mechanism 134, the end of the temporary stack section 130 is rotated on a rotation center 138 and thereby is upwardly and downwardly moved. The paper medium placed on the temporary stack section 130 is transferred to the second transfer section 150.

The money dispensing section 140 is externally formed on the dispensing device to transfer the paper media to a customer. The money dispensing section 140 receives the paper media from the temporary stack section 130 via the second transfer section 150. Since the money dispensing section 140 is formed in a shutter structure, it is possible to prevent an unauthorized user from forcibly taking the paper media from the outside.

When the temporary stack section 130 that is transferred to the upper portion is located to be parallel with the second transfer section 150, the second transfer section 150 operates to rotate toward the money dispensing section 140. The second transfer section 150 includes transfer rollers. Due to rotation of the transfer rollers, the second transfer section 150 may transfer the paper media and provide the transfer route. Also, the second transfer section 150 functions to transfer the paper media that is located in the transfer route by the temporary stack section 130, using a stack unit. Also, the second transfer section 150 may operate regardless of the first transfer section 120.

The second transfer section 150 may move a portion adjacent to the money dispensing section 140 to a rear portion as indicated by an arrow mark □. Therefore, when transferring uncollected paper media from the money dispensing section 140 to the reject box 160, the second transfer section 150 is moved to the rear portion to provide a retrieval space. The money dispensing section 140 rotates the transfer rollers toward the rear portion and thereby retrieves the paper media in the retrieval space.

Hereinafter, a process of transferring the paper media in the dispensing device of the cash transaction machine will be described. The paper media stored in the storage section 110 are transferred to the upper portion of the temporary stack section 130 via the first transfer section 120. The temporary stack section 130 with the paper media closely contacts with the bottom of the second transfer section 150 due to the cam rotation mechanism 134. The second transfer section 150 transfers the paper media from the temporary stack section 130 to the money dispensing section 140 to thereby provide to the customer.

The reject box 160 includes a reject box body 161 and a reject body shutter 163. The reject box 160 is selectively detachable from a receiving section 101. The receiving section 101 is provided below the first transfer section 120. The paper media that are not collected from the money dispensing section 140 may be retrieved using the reject box 160. Also, a locked state of the reject box shutter 163 may be selectively maintained and released by the locking member 164 that pivots according to the magnetic force between a fixed magnet 102 and a movable magnet 165.

The reject box body 161 is formed in the shape of a box that internally includes a predetermined space. A retrieval hole 162 is formed on the top surface of the reject box body 161 to retrieve the paper media. The reject box body 161 may be detachably disposed in the receiving section 101 using a general sliding scheme.

Also, the fixed magnet 102 is included in the receiving section 101 of the main body 100 and is formed in the shape of a bar with a predetermined length. When disposing the reject box body 161 in the receiving section 101, the fixed magnet 102 may enter inside of the reject box body 161.

The reject box shutter 163 is combined with the reject box body 161 to selectively open and close the retrieval hole 162 formed in the reject box body 161. The opening and closing scheme of the reject box shutter 163 may be variously modified based on the required condition and the design specification. For example, the reject box shutter 163 may be combined with the reject box body 161 to open and close the retrieval hole 162 using the general sliding scheme.

A guide rail (not shown) may be formed in an inner-side wall of the reject box body 161. The reject box shutter 163 may slide along the guide rail to open and close the retrieval hole 162. The structure and shape of the guide rail may be variously modified into a linear shape, a curved shape, and the like, based on the required condition and the design specification. Specifically, the guile rail may be formed in the curved shape. In this case, the reject box shutter 163 may move along the guide rail and thereby be curved. Therefore, it is possible to reduce a space for the shutter operation. Also, it is possible to improve the utility of the space and the degree of freedom for the design.

Also, the reject box shutter 163 may include at least one of a plurality of shutter slats, or a plurality of shutter grills that foldably connect to each other. Specifically, the reject box shutter 163 may include the plurality of shutter slats or the plurality of shutter grills that foldably connect to each other using a hinge scheme. In this case, the reject box shutter 163 may move along the guide rail and be folded in a multi-layer.

In the above-described exemplary embodiment, the reject box shutter 163 is constructed to open and close the retrieval hole 162 using the sliding scheme. However, it is only an example and thus the present invention is not limited thereto. Depending on embodiments, the reject box shutter 163 may rotate on one point and thereby open and close the retrieval hole 162 using the general rotation scheme.

Also, in the above-described exemplary embodiment, the reject box shutter 163 includes the plurality of shutter slats or the plurality of shutter grills. However, it is only an example and thus the present invention is not limited thereto. Specifically, depending on embodiments, the reject box shutter 163 may be formed in a single planar shape. In this case, the reject box shutter 163 may be formed of a flexible material that can be bent. Also, the reject box shutter 163 may be formed of a rigid material.

The locking member 164 is constructed to interoperate when the reject box body 161 is disposed in the receiving section 101, and thereby maintain and release the reject box shutter 163. For the above operation, a projection 163*a* may be formed in one end of the reject box shutter 163. The locking member 164 may be bound by the projection 163*a* and thereby may lock the reject box shutter 163.

Specifically, the movable magnet 165 is integrally formed in one end of the locking member 164. The locking member 164 is provided pivotably toward a first location capable of locking the reject box shutter 163 and a second location capable of releasing the reject box shutter 163 inside the reject box body 161. When the reject box body 161 is disposed in the receiving section 101, the locking member 164 may be pivoted toward the location of releasing the reject box shutter 163 due to a magnetic force between the fixed magnet 102 and the movable magnet 165.

Hereinafter, when the fixed magnet 102 and the movable magnet 165 are constructed to have the same polarity and thereby form a repulsive force between the fixed magnet 102 and the movable magnet 165, and the locking member 164 is constructed to pivot due to the repulsive force, will be described. Depending on embodiments, the fixed magnet 102 and the movable magnet 165 may be constructed to have different polarities and thereby form an attractive force between the fixed magnet 102 and the movable magnet 165. In this case, the locking member 164 may be constructed to pivot due to the attractive force.

A pivot bracket 164*b* may be combined with a side wall of the reject box body 161. Also, the pivot bracket 164*b* may include a pivot axis 164*a*. The locking member 164 may be combined with the pivot axis 164*a* to be pivotable on the pivot bracket 164*b*.

The movable magnet 165 may be fixed to the locking member 164 using a general combining member. Depending on embodiments, the movable magnet 165 may be adhered to the locking member 164 using a general adhesive scheme, or may be inserted into a separate receiving section.

According to the above construction, when the reject box 160 is detached from the box 100, the locking member 164 is disposed to bind the reject box shutter 163. When the reject box body 161 is disposed in the receiving section 101, the locking member 164 is pivoted on the pivot axis 164*a* due to the repulsive force between the fixed magnet 102, entering inside of the reject box body 161, and the movable magnet 165.

Also, a guide bracket 166 may be disposed adjacent to the locking member 164 inside the reject box body 161. When the fixed magnet 102 enters inside of the reject box body 161, the guide bracket 166 may be disposed between the fixed magnet 102 and the movable magnet 165.

The guide bracket 166 may guide the entering of the fixed magnet 102. Also, the guide bracket 166 may surround a side portion of the locking member 164 and thereby prevent the operation of the locking member 164 caused by the forceful manipulation from the outside.

Also, a hole 166*a* may be formed in the guide bracket 166. The magnetic force between the fixed magnet 102 and the movable magnet 165 may be formed through the hole 166*a*. Also, the magnetic force between the fixed magnet 102 and the movable magnet 165 may be formed while passing through the guide bracket 166. The hole 166*a* may be formed in the guide bracket 166 to form the sufficient magnetic force between the fixed magnet 102 and the movable magnet 165.

In this instance, the guide bracket 166 may be formed of a metal material capable of forming the attractive force with the movable magnet 165. When the guide bracket 166 is formed of the metal material, the attractive force operates between the movable magnet 165 and the guide bracket 166. The locking member 164 may be motionlessly maintained to keep the reject box shutter 163 locked. The repulsive force between the fixed magnet 102 and the movable magnet 165 must be greater than the attractive force between the fixed magnet 102 and the movable magnet 165.

In the above-described exemplary embodiment, the guide bracket 166 is formed of the metal material and an organized state of the locking member 164 is maintained due to the attractive force between the movable magnet 165 and the guide bracket 166. However, it is only an example and thus the present invention is not limited thereto. Specifically, depending on embodiments, the organized state of the locking member 164 may be elastically maintained using an elastic member such as a spring.

Figure 6:
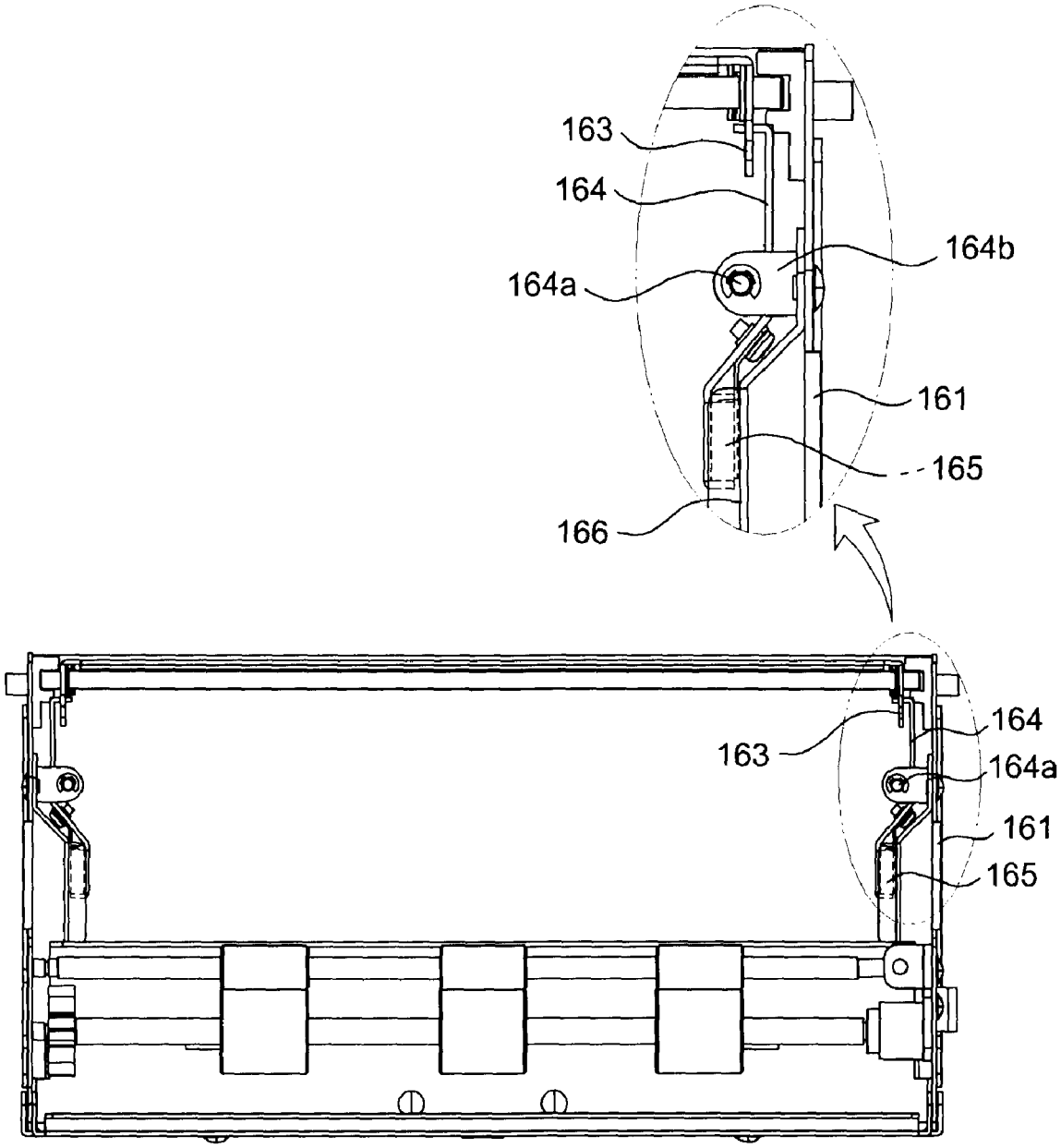
FIGS. 6 and 7 are side views illustrating an operational structure of a reject box for a cash transaction machine according to an exemplary embodiment of the present invention.
Figure 7:
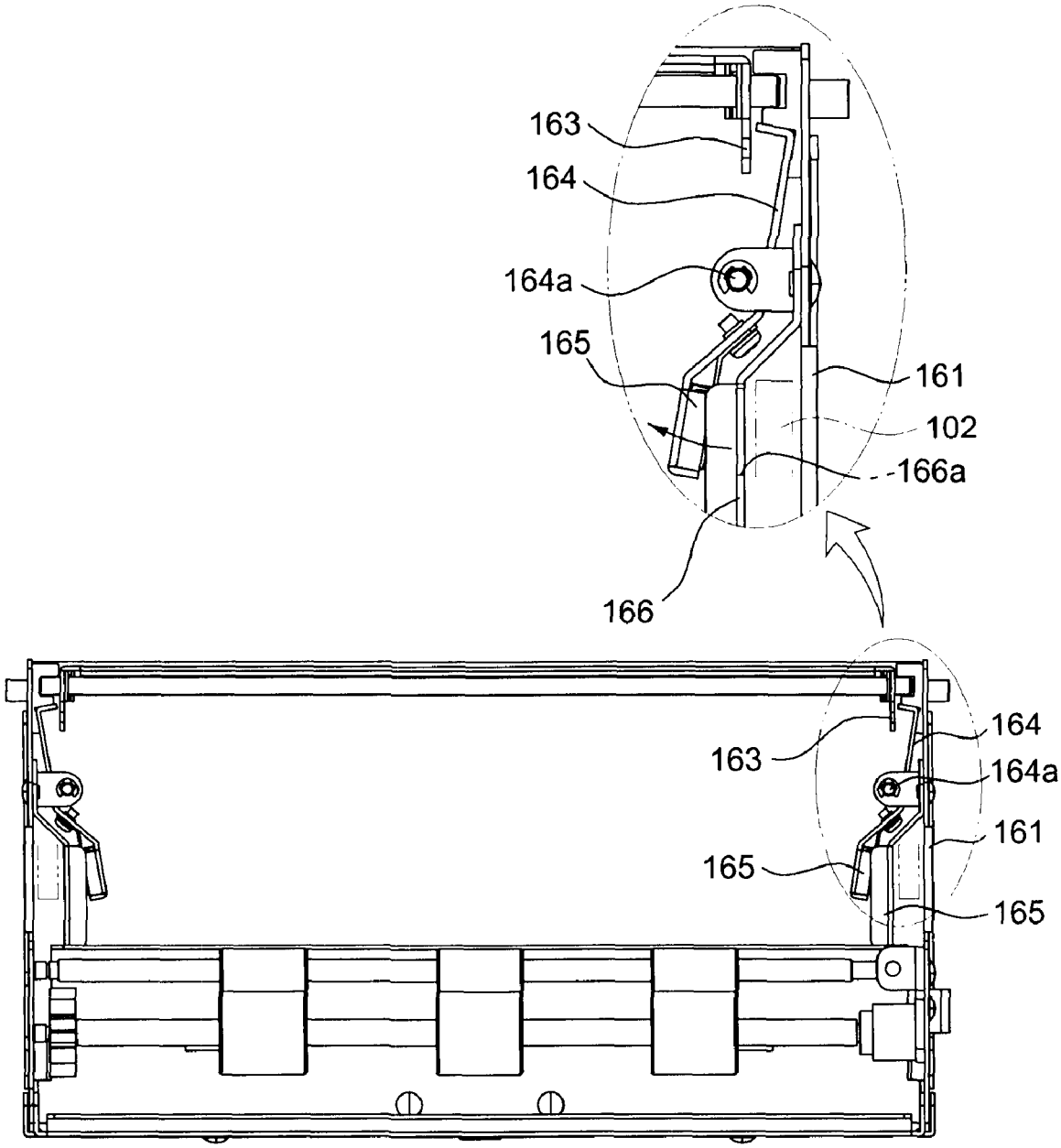

Hereinafter, an operational structure of a reject box according to the present invention will be described. FIGS. 6 and 7 are side views illustrating an operational structure of the reject box 160 for a cash transaction machine according to an exemplary embodiment of the present invention.

As shown in FIG. 6, when the reject box 160 is detached from the main body 100, the reject box shutter 163 where the retrieval hole 162 is closed may be bound by the locking member 164. In this instance, the organized state of the locking member 164 may be motionlessly maintained due to the attractive force with the metal guide bracket 166.

As shown in FIG. 7, when the reject box 160 is disposed in the receiving section 101 of the main body 100, the fixed magnet 102 included in the receiving section 101 may enter inside of the reject box body 161. Due to the repulsive force between the entered fixed magnet 102 and the movable magnet 165, the locking member 164 may pivot on the pivot axis 164*a* and thereby may release the reject box shutter 163.

After the locking member 164 releases the reject box shutter 163, the reject box shutter 163 may be opened. Specifically, the reject box shutter 163 may be opened automatically, or manually by manipulation of the operator.

Specifically, the locking member 164 may be constructed to interoperate when the reject box body 161 is disposed in the receiving section 101, and thereby to be automatically opened. For the above operation, a shutter protrusion 168 may be integrally formed in one end of the reject box shutter 163. The shutter protrusion 168 may be externally exposed from the reject box body 161. Also, a binding protrusion 103 may be formed to contact with the shutter protrusion 168 and thereby bind the shutter protrusion 168. According to the above structure, when the reject box body 161 is disposed in the receiving section 101, the shutter protrusion 168 may be bound by the binding protrusion 103. Therefore, the reject box shutter 163 may move along the guide rail toward an opposite direction to the disposed direction of the reject box body 161 and open the retrieval hole 162.

As described above, at the same time of providing the reject box 160, the locking member 164 may pivot due to the magnetic force between the fixed magnet 102 and the movable magnet 165 and thereby release the reject box shutter 163. As the shutter protrusion 168 is bound to the binding protrusion 103, the reject box shutter 163 may interoperate and thereby be automatically opened. Specifically, once the operator performs a providing process of the reject box 160, it may be possible to simultaneously perform releasing of the reject box shutter 163 and opening of the reject box shutter 163.

In the above-described exemplary embodiment, it is possible to simply retrieve an uncollected paper medium using the reject box 160. Also, when an abnormal paper medium is detected while transferring paper media along the first transfer section 120, the detected abnormal paper medium may be retrieved in another end of the reject box 160. In this instance, the detected abnormal paper medium may denote a bill that is internally determined as abnormal, a counterfeit bill, and the like.

Also, the reject box 160 may include an elastic member (not shown). The elastic member provides elasticity to enable the reject box shutter 163 to move toward a location capable of closing the retrieval hole 162. The elastic member may generally use a coil spring. When one end of the elastic member connects to the reject box body 161 and another end of the elastic member connects to the reject box shutter 163 to thereby release binding of the shutter protrusion 168, the elastic member may provide elasticity to enable the reject box shutter 163 to move toward a location capable of closing the retrieval hole 162. The type and structure of the elastic member is not limited or restricted by the present invention. Various types of elastic members may be used depending on the required condition and the design specification.

Although a few exemplary embodiments of the present invention have been shown and described, the present invention is not limited to the described exemplary embodiments. Instead, it would be appreciated by those skilled in the art that changes may be made to these exemplary embodiments without departing from the principles and spirit of the invention, the scope of which is defined by the claims and their equivalents.

What is claimed is:

1. A reject structure in a cash transaction machine, comprising:

a main body of the cash transaction machine including a receiving section, wherein a fixed magnet is included in the receiving section;

a reject box body being detachably disposed in the receiving section;

a reject box shutter being provided on the reject box body to open and close the reject box; and a locking member including a movable magnet in one end of the locking member and being provided pivotably toward a first location capable of locking the reject box shutter and a second location capable of releasing the reject box shutter inside the reject box body, a guide bracket being provided within the reject box body to be disposed between the fixed magnet and the movable magnet when the fixed magnet enters the reject box body, and being made of a metal material, wherein:

the movable magnet and the fixed magnet are formed to have a repulsive force therebetween greater than an attraction force between the guide bracket and the movable magnet, wherein when the reject box body is disposed in the receiving section, the locking member is pivoted toward the location capable of releasing the reject box shutter due to a magnetic force between the fixed magnet and the movable magnet, and when the reject box body is detached from the receiving section, the movable magnet is attached to the guide bracket and the locking member is pivoted toward a location capable of binding the shutter box shutter, the guide bracket is positioned to surround a side portion of the fixed magnet to guide entrance of the fixed magnet when the reject box body is received in the receiving section and is formed in a shape capable of surrounding a side portion of the locking member seen through an aperture via which the fixed magnet enters to prevent the locking member from being forcefully manipulated from an outside, and a hole is formed in the guide bracket and the magnetic force between the fixed magnet and the movable magnet is formed through the hole.

2. The reject structure of claim 1, wherein a projection is formed in one end of the reject box shutter and the locking member binds the projection.

3. The reject structure of claim 1, further comprising:

a pivot bracket combined with the reject box body, wherein the locking member is pivotably combined with the pivot bracket.

4. The reject structure of claim 1, wherein the reject box shutter is slidably combined with the reject box body to thereby be opened and closed.

5. The reject structure claim 1, wherein the reject box shutter includes a shutter protrusion that is externally exposed from the reject box body, and the main box body includes a binding protrusion that contacts with the shutter protrusion and binds the shutter protrusion, and when the reject box body is disposed in the receiving section, the shutter protrusion is bound by the binding protrusion and thereby interoperates to open the reject box shutter.

* * * * *